US005848169A

United States Patent [19]

Clark, Jr. et al.

[11] Patent Number: 5,848,169

[45] Date of Patent: Dec. 8, 1998

[54] FEEDBACK ACOUSTIC ENERGY DISSIPATING DEVICE WITH COMPENSATOR

[75] Inventors: Robert L. Clark, Jr., Durham, N.C.; Daniel G. Cole, Blacksburg, Va.

[73] Assignee: Duke University, Durham, N.C.

[21] Appl. No.: 809,611

[22] PCT Filed: Oct. 6, 1995

[86] PCT No.: PCT/US95/12951

§ 371 Date: May 6, 1997

§ 102(e) Date: May 6, 1997

[87] PCT Pub. No.: WO96/11466

PCT Pub. Date: Apr. 18, 1996

Related U.S. Application Data

[63] Continuation-in-part of Ser. No. 319,262, Oct. 6, 1994, abandoned.

[51] Int. Cl.[6] ..... G10K 11/16

[52] U.S. Cl. ..... 381/71.13; 381/71.7

[58] Field of Search ..... 381/71.3, 71.7, 381/71.13, 71.4

[56] References Cited

U.S. PATENT DOCUMENTS

| | | | |
|---|---|---|---|
| 4,455,675 | 6/1984 | Bose et al. | 381/74 |
| 4,883,719 | 11/1989 | Carme et al. | 381/72 |
| 4,899,387 | 2/1990 | Pass | 381/71 |
| 4,953,217 | 8/1990 | Twiney et al. | 381/72 |
| 4,965,832 | 10/1990 | Edwards et al. | 381/71 |
| 5,251,262 | 10/1993 | Suzuki et al. | 381/71 |
| 5,293,425 | 3/1994 | Oppenheim et al. | 381/71.8 |
| 5,363,451 | 11/1994 | Martinez et al. | 381/71.13 |
| 5,617,479 | 4/1997 | Hildebrand et al. | 381/71.3 |

FOREIGN PATENT DOCUMENTS

| | | | |
|---|---|---|---|
| 0237 454 A1 | 9/1987 | European Pat. Off. | G10K 11/16 |
| 0 539 939 A1 | 5/1993 | European Pat. Off. | G10K 11/16 |
| 2 149 614 | 6/1985 | United Kingdom | G10K 11/16 |
| 2 157 134 | 10/1985 | United Kingdom | H04H 7/00 |
| 94/11953 | 5/1994 | WIPO . | |

OTHER PUBLICATIONS

MAA Dahyou, "Active Noise Control of Reverberant Sound," *ACTA Acustica*, 16(5):322–329 (1991) (English Abstract).

H.F. Olson, et al., "Electronic Sound Absorber," *The Journal of the Acoustical Society of America*, 25(6):1130–1136 (1953).

S. Koshigoe, et al., "A New Approach for Active Control of Sound Transmission Through an Elastic Plate Backed by a Rectangular Cavity," *The Journal of the Acoustical Society of America*, 94(2), Pt.1:900–907 (1993).

(List continued on next page.)

*Primary Examiner*—Forester W. Isen

*Attorney, Agent, or Firm*—Hamilton, Brook, Smith & Reynolds, P.C.

[57] ABSTRACT

An acoustic energy dissipating device (100) comprises an acoustic driver (112) coupled to an acoustic medium and an acoustic sensor (110) for detecting a pressure of the acoustic medium near the acoustic driver. An inverting amplifier (115) and a compensator (114) are placed in a feedback system including the acoustic driver and the acoustic sensor. The compensator modifies the open loop phase response of the feedback system. Specifically, the compensator compensates for transduction device dynamics associated with the acoustic driver and the acoustic sensor to increase a gain margin of the feedback system. More specifically, the phase response of the open-loop system is constrained to alternate between +90 degrees and −90 degrees for each alternating complex conjugate pair of poles and zeros for an operational bandwidth of the device. In situations in which the acoustic characteristics of an enclosure in which the device is placed is dynamic, an adaptive gain feedback amplifier (120 not shown) can also be placed in the system for adaptively changing a feedback gain from the sensor to the driver according to a least-mean-squares or time-averaged gradient decent algorithm. Further a matched array of sensors-detectors can be used for applications with high modal densities or large enclosures.

26 Claims, 6 Drawing Sheets

OTHER PUBLICATIONS

M. L. Munjal, et al., "Analysis of a Linear One–Dimensional Active Noise Control System by Means of Block Diagrams and Transfer Functions," *Journal of Sound and Vibration*, 129(3):443–455 (1989).

M. L. Munjal, et al., "An Analytical, One–Dimensional, Standing–Wave Model of a Linear Active Noise Control System in a Duct," *Journal of the Acoustical Society of America*, 84(3):1086–1093 (1988).

T. L. Parrott, et al., "Analytical Study of Acoustic Response of a Semireverberant Enclosure with Application to Active Noise Control," *NASA Technical Paper 2472* (1985).

Kuo, S.M., "An Integrated Audio and Active Noise Control System," *Proceedings of the International Symposium on Circuits and Systems* (*ISCS*), *Institute of Electrical and Electronics Engineers*, vol. 4 of 4:2529–2532 (May 3, 1993).

160
FRF Magnitude
(Pa/V)
$10^2$
$10^1$
$10^0$
$10^{-1}$
$10^{-2}$
$10^{-3}$
0
100
200
300
400
500
600
700
800
900
1000
Frequency (Hz)

Phase (deg.)
200
100
0
-100
-200
0
100
200
300
400
500
600
700
800
900
1000
Frequency (Hz)

FEEDBACK ACOUSTIC ENERGY DISSIPATING DEVICE WITH COMPENSATOR

This application is a Continuation-in-Part application of U.S. patent application Ser. No. 08/319,262, filed Oct. 6, 1994, no abandoned, the contents of which is incorporated herein in its entirety.

BACKGROUND OF THE INVENTION

Sound control or attenuation techniques fall into two general categories: feedback and feedforward. Olson and May first developed a feedback system based upon the virtual acoustical earth principle. "Electronic Sound Absorber", *Journal of the Acoustical Society of America,* 25(6) (1953). Later, Chaplin, et al., in U.S. Pat. No. 4,527,282, disclosed a similar device designed primarily to control engine exhaust gases. Both of these systems are implemented by positioning an acoustic microphone a small distance from an acoustic loudspeaker. The output of the microphone is passed through an inverting amplifier, which is then used to drive the loudspeaker. The primary application for this approach has been to create a local quiet zone, or region of reduced sound pressure in front of the speaker.

Feedforward acoustic disturbance rejection relies on the availability of an uncontrollable reference signal that is correlated to the disturbance. An adaptive filter receives this reference signal along with usually an acoustic error signal and regulates the driving of a speaker to minimize the error signal. As a result, feedforward solutions tend to be ideal for harmonic input disturbances but less appropriate for stationary random or impulsive disturbances.

SUMMARY OF THE INVENTION

Feedback-based sound control systems better handle the random disturbances. The primary limitation of conventional feedback configurations, however, is that the frequency bandwidth of operation is severely limited by the transduction device, i.e., microphone and loudspeaker, dynamics. The stability and useful bandwidth of the system are defined by the gain margin and phase margin obtained from the Bode plot of the open-loop response. The microphone has a zero at the origin in the s-plane, a real pole typically somewhere between 2 and 8 Hz and a complex conjugate pair of poles at some higher frequency, typically in the kHz range, which dictates the bandwidth of the device. The acoustic loudspeaker has a complex conjugate pair of poles at some low-frequency (i.e., between 20 and 60 Hz) and a real pole due to the electrical dynamics. These additional dynamics, when coupled to an enclosed sound field, impose finite gain margins, limiting the useful bandwidth of operation. Thus, for direct output feedback control proposed in the prior art, an upper limit to the feedback gain results. Due to this limited bandwidth of operation, the prior art finds limited practical use.

The present invention concerns a system for dissipating or changing the characteristics of acoustic energy of a region, such as an enclosure. This system includes at least one acoustic sensor, for example a microphone, that is positioned close to an associated acoustic driver, such as a loudspeaker. An inverting amplifier is used to drive the acoustic driver in response to the sensor. A series electrical signal conditioning circuit, i.e., a compensator, is electrically interposed between the sensor and driver to modify the open loop response of the system.

The present invention finds particular application in the context of reverberant sound fields. When the control system is placed in the corner of a reverberant enclosure, or at the position of maximum response to the acoustic modes, the acoustic response generally in the lower frequencies of the reverberant sound field can be attenuated globally, i.e., at every point within the enclosure. The series compensator increases the robustness of the system while also extending the bandwidth of operation and degree of attenuation.

In specific embodiments, the compensator increases a gain margin of the system. In most situations, to increase the gain margin, the compensator must compensate for transduction device dynamics associated with the acoustic driver and/or the acoustic sensor. The compensator constrains the phase response to alternate between +90 degrees and −90 degrees for each alternating complex conjugate pair of poles and zeros for an operational bandwidth of the system.

In other embodiments, an adaptive gain feedback amplifier is also placed between the sensor and the driver to adaptively change the feedback gain in response to changes in the acoustic characteristics of an enclosure in which the system is placed. This adaptive gain feedback amplifier can implement a least-mean-squares or a time-average gradient decent algorithm for changing the feedback gain.

In still other embodiments, the system relies on a matched array of sensors and drivers. An input network combines the responses of the several sensors into a single error signal, usually with different weights applied on the inputs. The compensator is implemented as in the case of the single sensor-driver embodiment. The intent is not to implement independent modal space control, but build a distributed array that behaves as if it were a single sensor-driver pair. A driving network-power amplifier, being a cascaded amplifier and gain control network or array of power amplifiers, powers the drivers preferably each with a separately controlled gain.

In general, according to another aspect, the invention features a method for dissipating acoustic energy within an enclosure. This method comprises detecting a pressure in an acoustic medium with at least one acoustic sensor, each sensor being near a different acoustic driver within the enclosure. A signal, indicative of the pressure from the acoustic sensor(s), is inverted and the acoustic driver(s) is driven in response to this inverted signal. Finally, the frequency response of the series compensator of the feedback system that includes the acoustic driver and the acoustic sensor is modified.

In specific embodiments, this frequency response is modified by increasing a gain margin of the feedback system. The frequency response may be modified to compensate for transduction device dynamics associated with the acoustic driver and/or the acoustic sensor.

In still other preferred embodiments, a feedback gain of the feedback system is changed in response to changes in acoustic characteristics of the enclosure.

The above and other features of the invention including various novel details of construction and combinations of parts, and other advantages, will now be more particularly described with reference to the accompanying drawings and pointed out in the claims. It will be understood that the particular method and device embodying the invention is shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings like reference characters refer to the same parts throughout the different views. The drawings are not necessarily to scale, emphasis instead being placed upon illustrating the principles of the invention. Of the drawings.

DETAILED DESCRIPTION OF THE PREFERRED EMBODIMENTS

Figure 1:
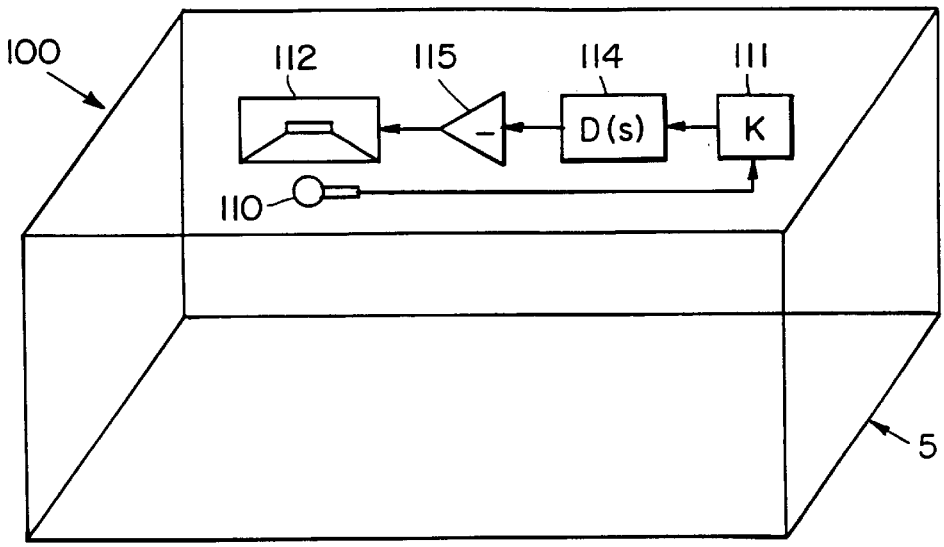
FIG. 1 is a perspective schematic view of the acoustic energy dissipating device of the present invention mounted within an enclosure.

Turning now to the drawing, an acoustic energy dissipating device 100 constructed according to the principles of the present invention is schematically shown in FIG. 1. Specifically, an acoustic sensor such as a microphone 110 and an acoustic driver such as a loudspeaker 112 are placed within an enclosure 5 effectively collocated from the perspective of the longer wavelengths of lower frequency sound.

In the preferred embodiment, the microphone 110 and loudspeaker 112 are effectively collocated for frequencies lower than approximately 1 kHz. The microphone, however, is intentionally spaced apart from the loudspeaker 112 by a distance sufficient to achieve spatial filtering of high frequency sound, i.e., greater than approximately 1 kHz. This configuration increases the gain margin.

The output of the microphone 110 is passed through a feedback gain amplifier K 111, a series compensator D(s) 114, and an inverting amplifier 115. The amplifier generates the control input necessary to drive the loudspeaker 112.

The device 100 is ideally placed within a reverberant sound field such as that generated within the enclosure 5. The loudspeaker 112 and microphone 110 should be positioned in the corner of the enclosure 5 to enable coupling to all of the low-frequency acoustic modes of the reverberant sound field.

The compensator 114 is included to constrain the phase response of a coupled system, including the enclosure 5 and acoustic energy dissipating device 100, to behave as an ideal system, i.e., without transduction device dynamics, over the acoustic bandwidth in which attenuation is desired. Compensator design depends, to some extent, on the enclosure's acoustic response since this response is coupled to the mechanical response of the loudspeaker 112.

Figure 2:
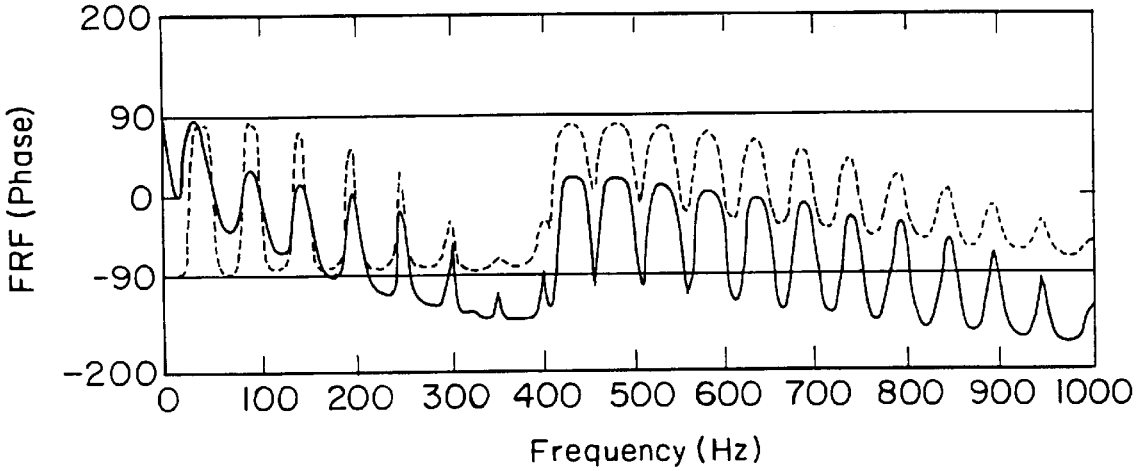
FIG. 2 shows the different phase responses for a feedback system having an ideal volumetric source (dotted line) and an actual system having transduction device dynamics (solid line)

Referring to FIG. 2, the phase response of an actual uncompensated coupled system is shown (solid line) by a Bode plot of the open-loop system phase response in a reverberant enclosure. The phase is not constrained between +90 degrees and −90 degrees as is the response of the coupled system with an ideal volumetric source (dotted or broken line). Dynamics associated with the speaker and microphone destroy the symmetry present in the ideal system and thus undermine the stability of the system and useful bandwidth of operation as defined by the gain and phase margins.

A preferred embodiment of the compensator relies on bounding the phase response of the open-loop coupled system to alternate between +90 degrees and −90 degrees for each alternating complex conjugate pair of zeros and poles, respectively. Two approaches may be followed. A heuristic method begins by obtaining experimental frequency, phase, and magnitude response measurements of the device 100 in the enclosure 5 of interest to a white noise input signal across the frequency range of interest, usually 0 to approximately 1 kHz. Analysis of the resulting data will suggest a suitable transfer function for the compensator. Further frequency response tests of the coupled system including the compensator are then used to refine the design.

Figure 3A:
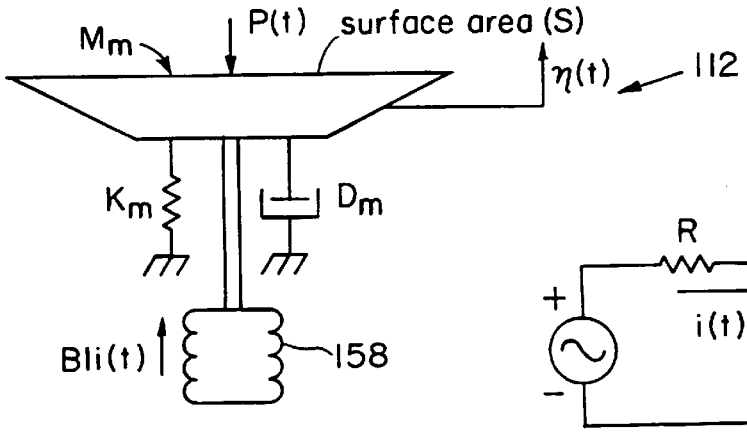
FIGS. 3*a* and 3*b* show a mechanical schematic and an electrical schematic, respectively, of an acoustic loud speaker.
Figure 3B:
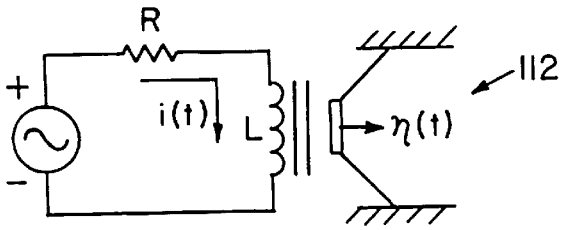

Alternatively, the compensator's design can be mathematically based by deriving a model of the coupled system. With reference to FIGS. 3*a* and 3*b*, the loudspeaker 112 can be modeled as a moving coil device with second-order mechanical dynamics and first-order electrical dynamics. The dynamic response of the mechanical system can be computed from the following second-order differential equation:

$$M_m\ddot{\eta}(t)+D_m\dot{\eta}(t)+K_m\eta(t)=Bli(t)-p(t)S,$$

where $M_m$ is the mass of the moving mechanical system, $D_m$ is the mechanical damping, $K_m$ is the mechanical stiffness, B is the field strength, l is the length of the conductor, p(t) is the acoustic pressure, S is the surface area of the loudspeaker diaphragm, i(t) is the current in the moving coil armature 158, and η(t) is the displacement of the speaker diaphragm. The system is thus forced by any acoustic loading, by the sound field within the enclosure 5, and by the applied electromotive force.

The electrical system of the speaker can be described as follows:

$$L\frac{di(t)}{dt}+Ri(t)=v_a(t)-Bl\dot{\eta}(t),$$

where L is the inductance, R is the resistance, and $v_a(t)$ is the applied voltage. As indicated by the equations, an applied voltage serves to generate current in the electrical system, which in turn causes a mechanical displacement. In addition, any mechanical response of the system due to external forces serves to generate voltage in $Bl\dot{\eta}(t)$, and thus current.

In determining the coupling of the loudspeaker 112 to the acoustic field within the enclosure, the loudspeaker can be modeled as a piston that is coupled to the acoustic field via the speaker diaphragm. The general structural response of this piston can be described in terms of the linear stiffness, a linear mass operator, and an externally applied force, as well as the acoustic pressure. The structural displacement of the model piston is effected by the acoustic modes that dominate the sound field within the enclosure 5. By integrating the acoustic mode shape over the surface of the loudspeaker diaphragm, coupling to the modes of the reverberant enclosure 5 is obtained.

If the loudspeaker 112 is centered on a nodal line of an acoustic mode of the enclosure 5, it cannot couple to that particular mode. Although the ideal volumetric source is theoretically capable of coupling to rigid body mode regardless of the location within the enclosure, practical issues such as the frequency response of the electromechanical transduction device must be considered as well. The preferred location for a loudspeaker is at a corner of the general 3-dimensional enclosure if the objective is to effectively couple to all of the acoustic modes.

Figure 4:
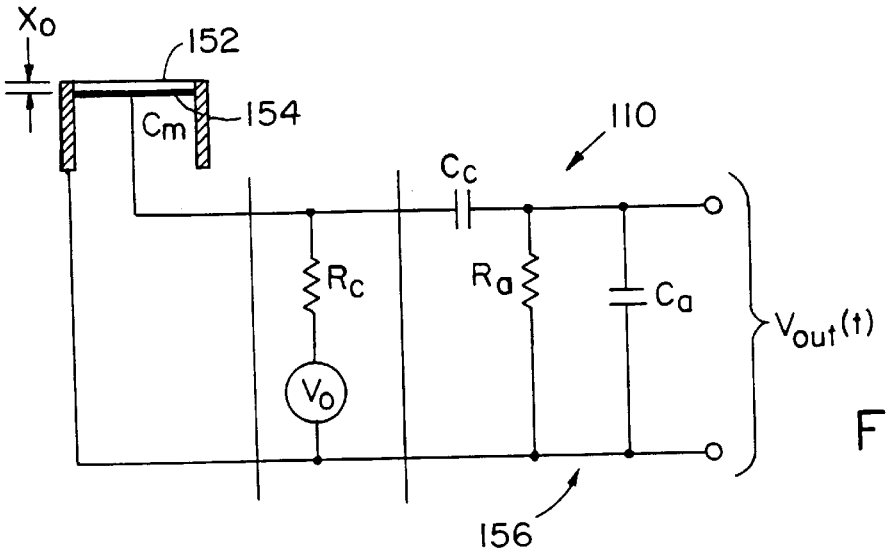
FIG. 4 is a schematic diagram of an equivalent model of a microphone and preamplifier.

A simplified schematic diagram of a condenser microphone 110 is illustrated in FIG. 4. Since the displacement of the condenser microphone diaphragm 152 is related to the acoustic pressure, the previously developed model of the coupled system can be placed in series with an appropriate model of the microphone and associated dynamics of the preamplifier 156. A DC polarization voltage $V_o$is applied across the back plate 154 and diaphragm 152 of the condenser microphone as illustrated in FIG. 4. The voltage is a function of the charge and capacitance of the device, and the output voltage can be expressed in terms of the acoustic pressure:

$$\frac{V_{out}(s)}{p(s)} = \frac{C_m V_o A_m}{Cm_m \chi_o}\left[\frac{s}{(s+1/RC)(s^2+2\xi_m\omega_m s+\omega_m^2)}\right],$$

where $C_m$ is the capacitance of the microphone, $m_m$ is the mass of the microphone diaphragm 152, $x_o$ is the air gap between the diaphragm 152 and the back plate 154, $A_m$ is the surface area of the diaphragm, $V_o$ is the polarization voltage, $R=R_cR_a/(R_c+R_a)$, $R_c$ is the coupling resistance between the pre-amplifier and the microphone, $R_a$ is the resistance the pre-amplifier, $C=C_m+C_c$, $C_c$ is the coupling capacitance between the preamplifier and the microphone, $\xi_m$ is the damping ratio of the microphone membrane, $\omega_m^2=(K_m+V_o/x_o)/M_m$ and $K_m$ is the stiffness of the diaphragm 152.

An exemplary coupled system has a zero at the origin and three poles. For the B&K type 4135 microphone, for example, one must place a real pole at approximately 2 Hz to accurately capture the dynamics of the microphone-preamplifier system and a complex-conjugate pair of poles corresponding to the first resonance frequency of the microphone diaphragm at approximately 15 kHz. One should recognize that the poles at 15 kHz really do not affect the system response over the frequency range of interest and for reasonably low feedback gains.

The acoustic energy dissipating device 100 finds particular application where a sound field within the enclosure is reverberant as assumed above. In this application, the present invention globally attenuates the acoustic energy within the enclosure 5. Kinetic and potential energy of the sound field decrease with time. Further, the system is asymptotically stable. In effect, the device adds damping to the acoustic modes of the enclosure to globally remove energy, kinetic and potential, for the acoustic field.

Adaptive Gain Control

Figure 5:
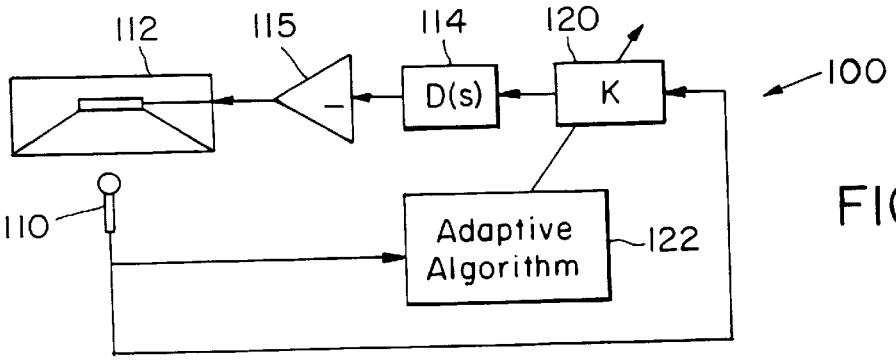
FIG. 5 shows an acoustic energy dissipating device according to another embodiment of the present invention.

An alternative embodiment of the inventive device 100 is illustrated in FIG. 5. The embodiment of FIG. 1 is a fixed gain implementation in which the feedback gain amplifier 111 necessary to attenuate the low-frequency response of the enclosure is set to a fixed value. In FIG. 5, adaptive feedback is implemented in the control system design. A controller 122 relying on an adaptive algorithm, such as a least-mean-squares or a time-averaged gradient descent, is used to adapt the feedback gain K 120. This adaptive version affords the advantage of being able to modify the gain and maintain stability in the presence of time-varying parameters which characterize the reverberant enclosure frequency response such as the number of people in the enclosure, changes in temperature, the number of open windows or doors, etc.

Figure 6B:
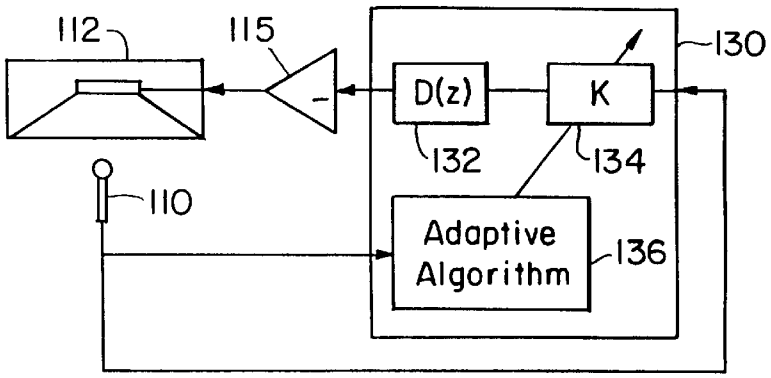
FIGS. 6*a* and 6*b* show digital implementations of the acoustic energy dissipating device having a fix gain and an adaptive gain, respectively, according to still another embodiment of the present invention.
Figure 6A:
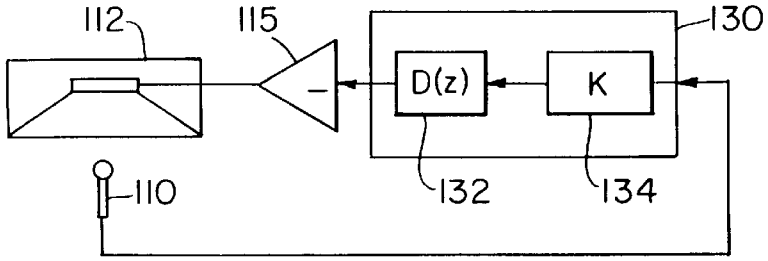

As an alternative to the analog implementations of FIGS. 1 and 5, digital systems are shown in FIGS. 6*a* and 6*b*. Here, control systems illustrated are realized in digital hardware, digital signal processor 130, as opposed to analog hardware. The basic principles of operation are the same. FIG. 6*a* represents the fix gain version in which compensator 132 and feedback gain 134 are implemented in the digital processor 130, and FIG. 6*b* shows the adaptive algorithm 136 also implemented.

Figure 7:
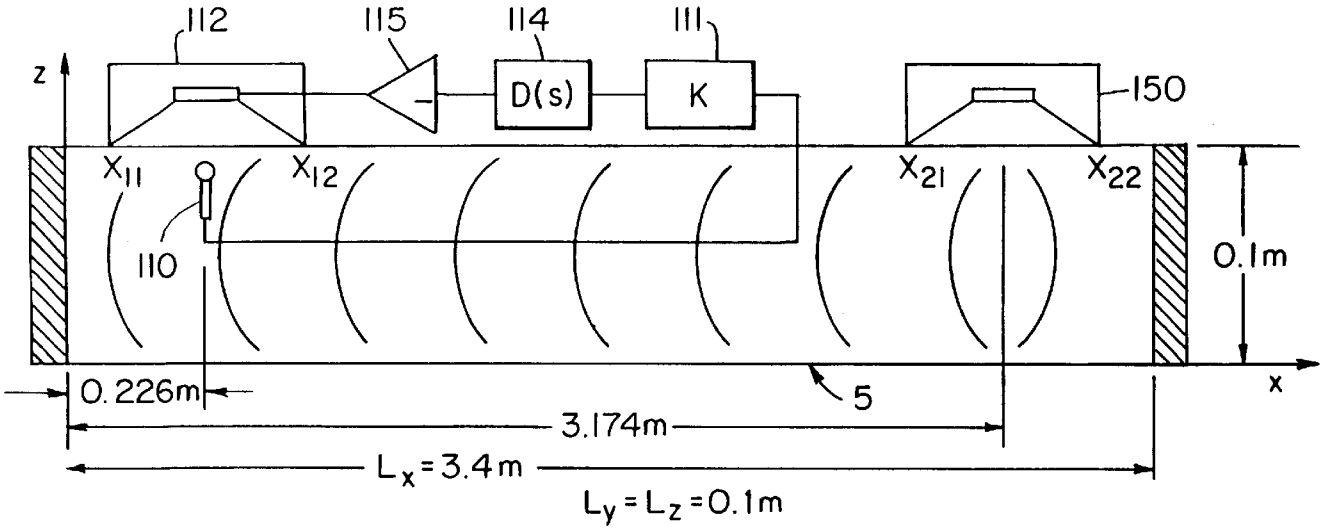
FIG. 7 is a schematic diagram of an experimental model used to demonstrate the advantages of the present invention.

To provide an indication of the improvement in the performance of the invention over prior art, an experimental enclosure was constructed, and the control system design was implemented. A schematic diagram of the experimental enclosure is illustrated in FIG. 7. The enclosure measured 3.4 m×0.1 m×0.1 m and was constructed from hardwood. An acoustic loudspeaker 150 was placed at one end of the enclosure 5, designated the disturbance loudspeaker and was used to excite the broadband response of the enclosure between 0 Hz and 1000 Hz. At the opposite end of the enclosure 5, an acoustic loudspeaker 112 was mounted to the wall of the enclosure, termed the control loudspeaker and was used to control the acoustic response of the enclosure 5. A microphone 110 was positioned in the center-plane of the control loudspeaker 112, and the output of the microphone 110 was amplified by a feedback gain amplifier 111 (having a gain K=5) and filtered with series compensator 114. The series compensator design of the example is obtained from the following expression:

$$D(s) = K\frac{(z+2\pi\times 97)(z+2\pi\times 100)}{(p+2\pi\times 10)(p+2\pi\times 778)}$$

The output of the compensator 114 was inverted with the amplifier 115 required to supply the necessary control signal for the acoustic loudspeaker 112.

Figure 8A:
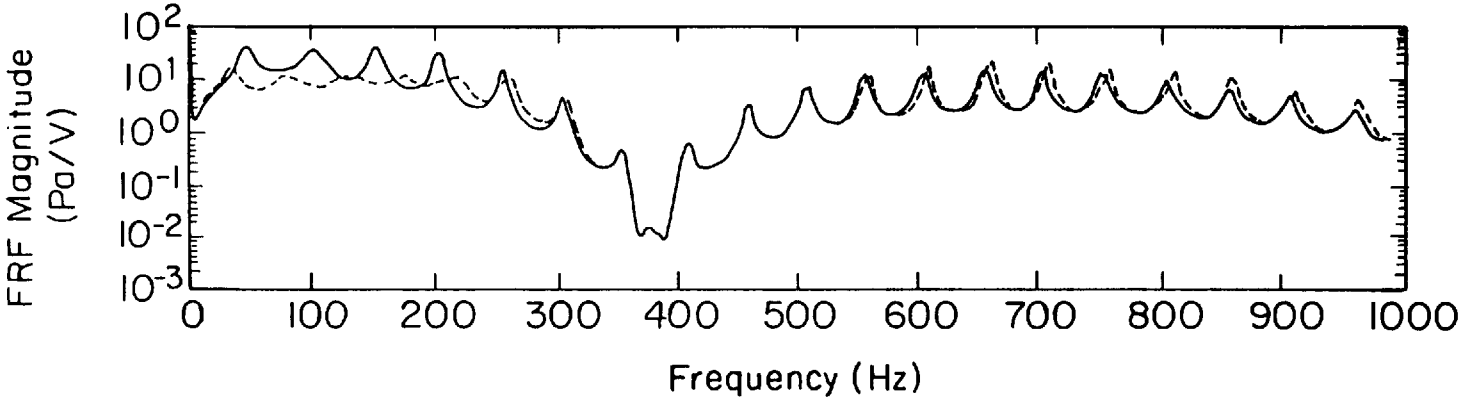
FIGS. 8*a* and 8*b* show the magnitude and phase responses, respectively, as a function of frequency comparing the open-loop, solid lines, and closed-loop, dashed lines, frequency response functions between the disturbance loud speaker and the control error microphone of FIG. 7 with direct output feedback control.
Figure 8B:
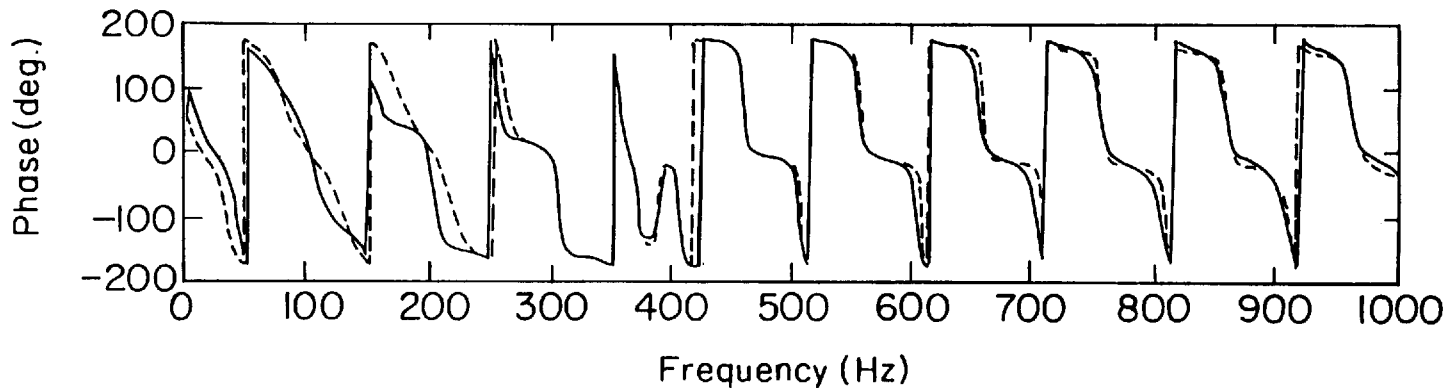

To demonstrate the invention, the first test was conducted with direct output feedback control (prior art), no series compensation. The results from this test are presented in FIG. 8. The frequency response functions between the disturbance loudspeaker 150 of FIG. 7 and the control error microphone 110 both open-loop (solid line) and closed-loop (broken or dotted line) were measured. As illustrated, approximately 9 dB of attenuation in the acoustic response of the enclosure was obtained between 0 Hz and 200 Hz. However, the acoustic response of the enclosure was observed to increase slightly at frequencies greater than 200 Hz. This observation is due to the fact that the transduction device dynamics impose finite gain and phase margins in the coupled system and destroy the symmetry associated with the "ideal" collocated system.

Figure 9A:
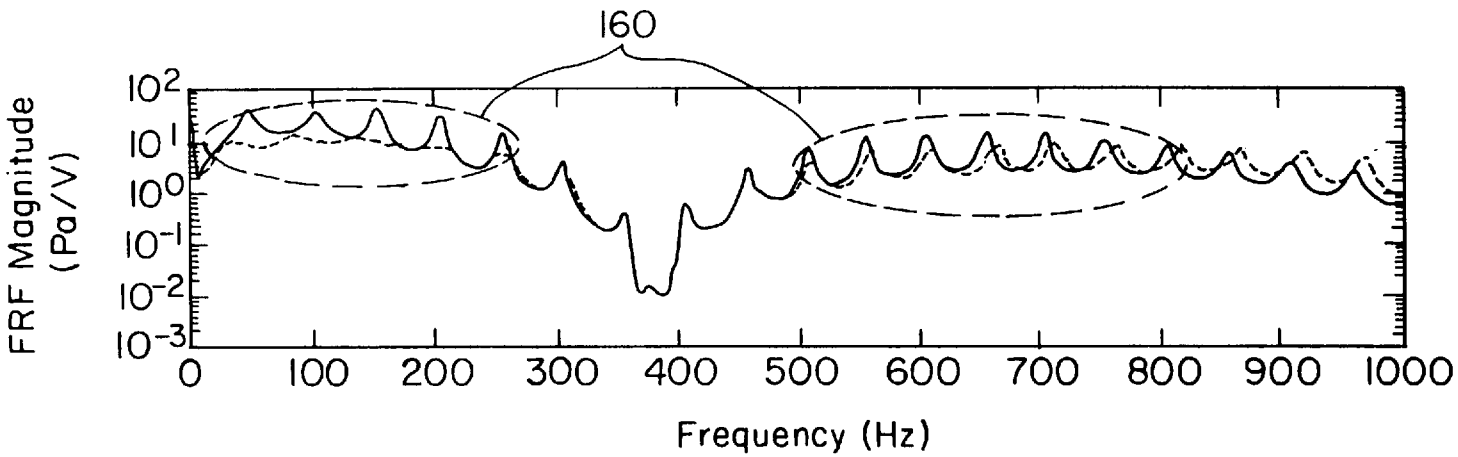
FIGS. 9*a* and 9*b* show the magnitude and phase responses, respectively, as a function of frequency comparing the open-loop, solid lines, and closed-loop, dashed lines, frequency response functions between the disturbance loud speaker and the control error microphone of FIG. 7 with direct output feedback control with the series compensation of the present invention.
Figure 9B:
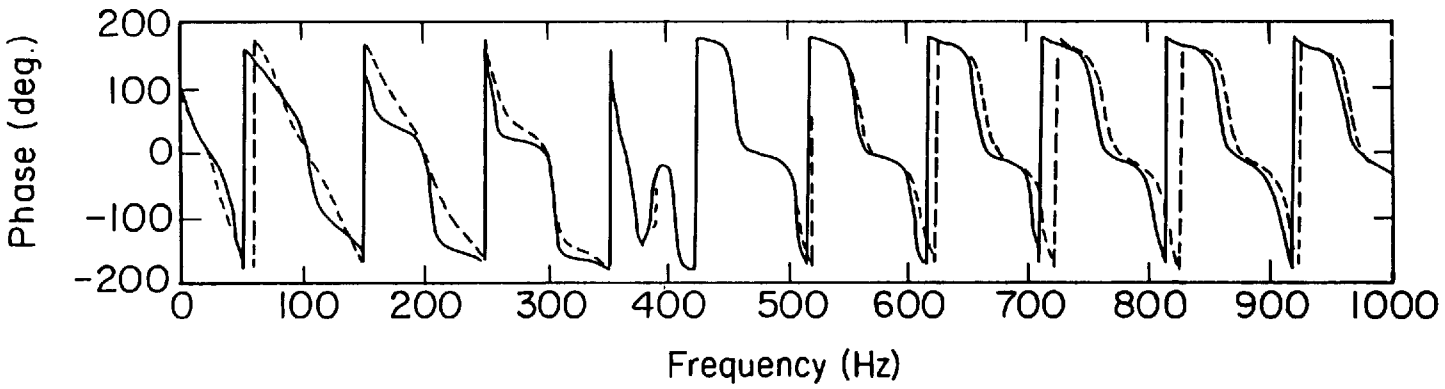

Results from tests conducted with the invention utilizing series compensation are presented in FIG. 9. The open-loop (solid line) and closed-loop (broken or dotted line) frequency response functions were measured between the disturbance source and the control error microphone. As illustrated in FIG. 9, approximately 16 dB of attenuation was obtained between 0 Hz and 1000 Hz. In addition, the acoustic response of the enclosure was suppressed between 200 Hz and 800 Hz as well, in contrast to the results presented in FIG. 8. The performance improvements are circled 160 in FIG. 9 to demonstrate the frequency ranges of enhanced control. The acoustic response between 300 Hz and 500 Hz remained relatively unchanged in both control experiments since the control loudspeaker 112 illustrated in FIG. 7 is positioned near the nodal points of the (7, O, O) and (8, O, O) modes of the enclosure at these frequencies.

Matched Array of Sensors and Drivers

Figure 10:
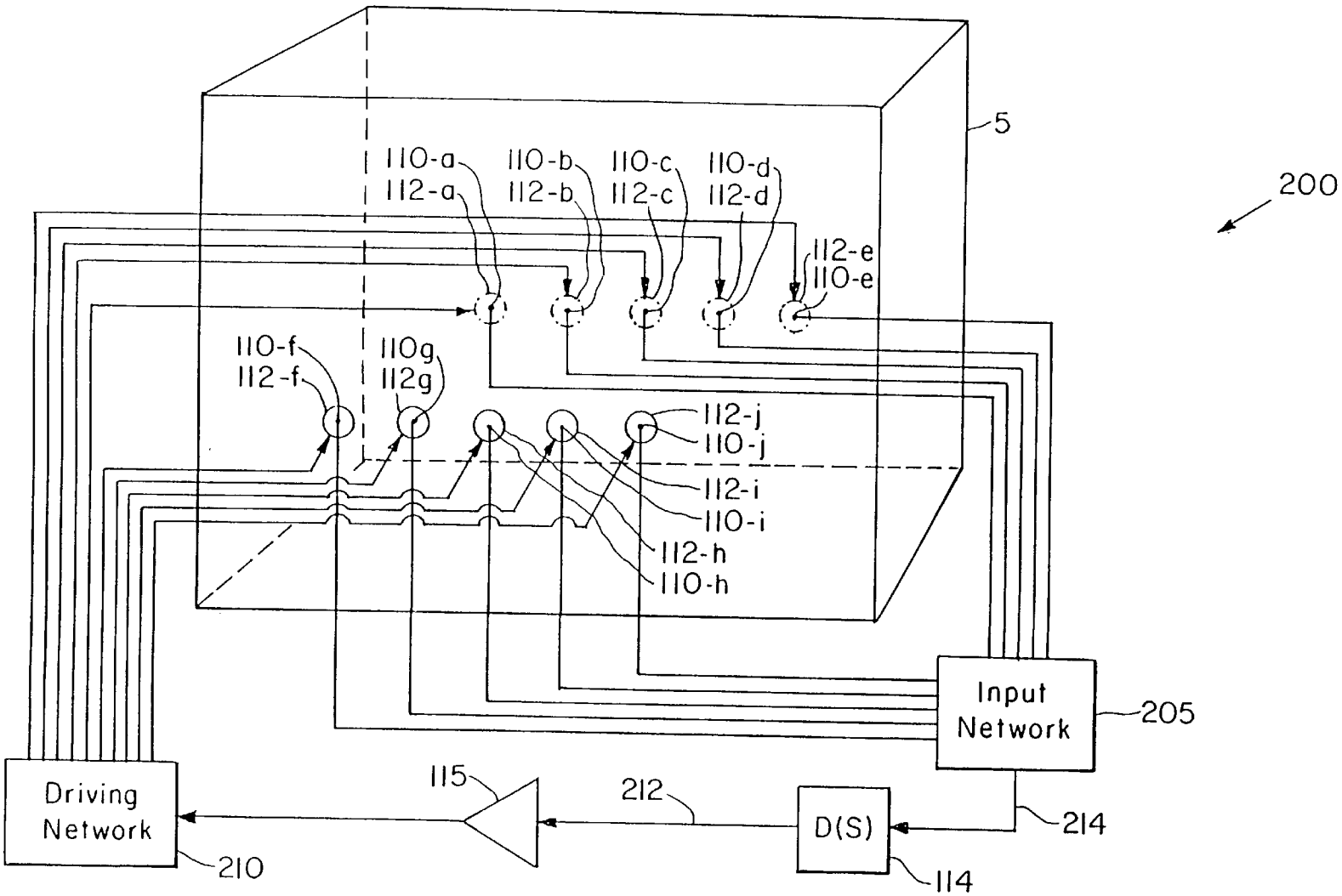
FIG. 10 is a schematic view of a third embodiment of the acoustic energy dissipating device of the present invention.

FIG. 10 illustrates a third embodiment 200 of the present invention that is adapted for acoustic field control in larger enclosures and/or where the modal density is very high. A matched array of acoustic sensors 110 and drivers 112 is distributed throughout an enclosure or room 5 in which the acoustic field is to be controlled. In the specific example illustrated, each of ten speaker 112*a–j* is paired with an associated microphone 110*a–j*. This number of speaker-microphone pairs, however, is not critical but is determined by cost factors, enclosure size, and bandwidth of the desired control. In each speaker-microphone pair, the microphone 110 is located close to the associated speaker 112 to be effectively co-located from the perspective of the longer wavelengths of sound for which control is desired. The distance, however, can be manipulated to allow spatial filtering of the higher frequencies.

The electrical feedback loop between the speakers 112 and microphones 110 includes an input network 205 for summing the outputs of all of the microphones. A set of weighting parameters, or gains, is applied to the inputs from each microphone 10*a–j* in the preferred embodiment. The error signal 214 generated from this weighted combination of the microphone responses is presented to an electrical conditioning circuit or compensator 114. As described earlier, the compensator 114 is designed to compensate for the transduction device dynamics of the speakers 112*a–j* and microphones 110*a–j* and constrain the response to emulate that of a positive real system over the bandwidth of interest. That is, the compensator 114 modifies the phase response of the system 200 to alternate between +90°and −90°. A control signal output 212 of the compensator 114 is then provided to an inverting amplifier 115 if sound attenuation is being performed. The amplifier 115 drives the speakers 112*a–j* through a driving network 210. The weighting or gain of the individual speakers is also controllable at the driving network 210.

Although illustrated as discrete components to demonstrate parallelism with earlier-described embodiments, the function of the driving network 210 and amplifier 115 are usually more conveniently built into a single network. For example, the output of the compensator 114 will usually be split among several amplifiers, each driving a separate speaker. The weighting or gain to each speaker is then adjusted by controlling the gain of the amplifier driving that speaker.

The gains applied by the input network 205 and the driving network 210 are adjusted or selected to emphasize control of specific acoustic modes of the enclosure 5. The same net gain, however, is applied to each transducer pair, the speaker and microphone. For example, if the input network 205 places a net gain of 5 on microphone 110-*d*, then the driving network 210 will place a gain of 5 on speaker 112-*d*. These matched gain sets, however, must account for the non-ideal characteristics of the transduction devices. That is, if a microphone offers more gain than the other devices, the input network 205 must account for this difference. This guarantees that the transducers are substantially co-located for the purpose of control and achieve the same stability characteristics of the single transducer pair described in the previous embodiments. This factor further allows basically the same compensator design as described earlier.

The weighting functions applied by the input network 205 and driving network 210 are determined by the modal participation corresponding to each spatial location of the speaker-microphone pair for the mode of interest. The objective, however, is not to implement independent modal space control, but rather build a distributed array of transducers that can be treated as a single substantially "co-located" transducer to modify the impedance of the acoustic enclosure such as decreasing the acoustic response to transient disturbances. As described, a single error signal 214 is received by the compensator 114. Thus, the input and output array are treated as a single piecewise distributed microphone and speaker.

Various weighting distributions can be assigned to implement alternative distributed transducers. Also, multiple transducers can be implemented simultaneously to control specific groups of acoustic modes, particularly at low frequencies where the acoustic wavelength is long and passive control approaches are impractical.

The distributed transducer arrays of this embodiment are effective in the control of acoustic enclosures where the modal density, the number of acoustic modes per unit frequency, is very high. Thus, it is impractical to utilize this approach to control all acoustic modes. Where a limited number of low frequency modes, however, can be targeted for modification, the impedance associated with these modes can be modified for the enclosure enabling the dissipation of acoustic energy through the distributed array.

The control system 200 and weighting functions schematically shown by the input network 205 and driving network 210 can be implemented in analog hardware, digital hardware or a hybrid combination of the two. In addition, adaptive algorithms can be employed to modify the weights such that the acoustic response is minimized in specific targeted bandwidths. Methods utilized in the adaptation of artificial neural networks can be employed here for the purpose of the non-linear optimization required to determine the optimal weights for minimizing the acoustic response over a desired bandwidth.

While this invention has been particularly shown and described with references to preferred embodiments thereof, it will be understood by those skilled in the art that various changes in form and details may be made therein without departing from the spirit and scope of the invention as defined by the appended claims.

We claim:

1. A system for modifying an acoustic response of enclosures within a frequency range of interest, the system comprising:

acoustic drivers coupled to an acoustic medium for driving an acoustic field thereof;

acoustic sensors for detecting the acoustic field of the acoustic medium and generating a response signal proportional to the detected field, each one of the acoustic sensors being effectively collocated with an associated one of the acoustic drivers relative to the frequency range of interest; and an inverting amplifier responsive to the signal for driving the acoustic drivers in response to the acoustic sensors.

2. A system as described in claim 1, further comprising an adaptive gain feedback amplifier for adaptively changing feedback gain from the acoustic sensors to the acoustic drivers in response to changes in acoustic characteristics of the enclosure.

3. A system as described in claim 1, further comprising a compensator interposed between the acoustic sensor and the acoustic driver for modifying an open-loop phase response of the system.

4. A system as described in claim 1, further comprising:

at least five of the acoustic drivers; and at least five corresponding acoustic sensors, each one of the sensors for detecting the acoustic field of the acoustic medium near a different one of the drivers.

5. A system as described in claim 1, further comprising an input network for combining the responses of each one of the acoustic sensors into a single response signal, to which the amplifier is responsive.

6. A system as described in claim 5, wherein the input network applies different weighting parameters controlling the relative levels of the responses from the acoustic sensors.

7. A system as described in claim 1, further comprising a driving network for splitting an output of the amplifier to drive the acoustic drivers.

8. A system as described in claim 7, further comprising an input network for combining into a response signal and controlling the relative levels of the responses of each one of the acoustic sensors, wherein the driving network and the input network apply the same net gain to each associated pair of the acoustic sensors and the acoustic drivers.

9. A system as described in claim 1, wherein the acoustic sensors are microphones.

10. A system as described in claim 3, wherein the compensator increases a gain margin of the system.

11. A system as described in claim 3, wherein the compensator compensates for transduction device dynamics associated with the acoustic driver and/or the acoustic sensor.

12. A system as described in claim 1, wherein each acoustic sensor is substantially collocated with the acoustic driver with respect to low frequency sound.

13. A system as described in claim 1, wherein the acoustic drivers and the acoustic sensors are located within an enclosure.

14. A system as described in claim 2, wherein the adaptive gain feedback amplifier implements a least-mean-squares or a time-averaged gradient descent algorithm for changing the feedback gain.

15. A system as described in claim 1, wherein the acoustic driver is a loudspeaker.

16. A system as described in claim 1, wherein the acoustic drivers are loudspeakers.

17. A system as described in claim 1, further comprising:

an input network for combining the responses of each one of the acoustic sensors into a single response signal, to which the amplifier is responsive;

a compensator for receiving the response signal to modify an open-loop phase response of the system; and a driving network that applies weighting parameters controlling the level to which each one of the acoustic drivers is driven.

18. A system as described in claim 17, wherein the driving network and the input network apply the same net gain to each associated pair of the acoustic sensors and the acoustic drivers.

19. A method for modifying an acoustic response of a region, the method comprising:

effectively collocating acoustic sensors with respective acoustic drivers;

detecting a pressure with the acoustic sensors of an acoustic medium near the acoustic drivers;

combining the responses of the acoustic sensors into a response signal; and driving the acoustic drivers in response to the response signal.

20. A method as described in claim 19, further comprising adaptively changing feedback gain from the acoustic sensors to the acoustic drivers in response to changes in acoustic characteristics.

21. A method as described in claim 19, further comprising modifying an open-loop phase response of a system including the acoustic sensors and drivers.

22. A method as described in claim 19, further comprising detecting the acoustic field of the acoustic medium with at least five of the acoustic sensors near respective drivers.

23. A method as described in claim 19, further comprising applying different weighting parameters controlling the gain level of each one of the acoustic sensors.

24. A method as described in claim 23, further comprising applying the same net gain to each associated pair of the acoustic sensors and the acoustic drivers before and after the combination of the responses.

25. A method as described in claim 19, further comprising locating the acoustic sensors and drivers within an enclosure.

26. A method as described in claim 19, further comprising inverting the response signal supplied to the drivers.

* * * * *